US009412285B2

(12) United States Patent
Ramirez, III

(10) Patent No.: US 9,412,285 B2
(45) Date of Patent: Aug. 9, 2016

(54) LAW ENFORCEMENT OFFICER IDENTIFIER

(71) Applicant: Albert Ramirez, III, El Paso, TX (US)

(72) Inventor: Albert Ramirez, III, El Paso, TX (US)

( * ) Notice: Subject to any disclaimer, the term of this patent is extended or adjusted under 35 U.S.C. 154(b) by 0 days.

(21) Appl. No.: 14/526,469

(22) Filed: Oct. 28, 2014

(65) Prior Publication Data

US 2015/0113845 A1 Apr. 30, 2015

Related U.S. Application Data

(60) Provisional application No. 61/896,257, filed on Oct. 28, 2013.

(51) Int. Cl.

| | |
|---|---|
| ***G09F 21/02*** | (2006.01) |
| ***G09F 3/18*** | (2006.01) |
| ***G09F 3/00*** | (2006.01) |
| ***G09F 13/00*** | (2006.01) |
| ***G09F 3/20*** | (2006.01) |

(52) U.S. Cl.

CPC .. *G09F 3/00* (2013.01); *G09F 3/18* (2013.01); *G09F 3/207* (2013.01); *G09F 13/00* (2013.01); *G09F 21/02* (2013.01)

(58) Field of Classification Search

USPC ..... 40/586, 1.5, 661.02; 63/3, 4, 9; 224/260, 603, 605, 257

See application file for complete search history.

(56) References Cited

U.S. PATENT DOCUMENTS

| | | | | |
|---|---|---|---|---|
| 4,091,974 | A * | 5/1978 | McClintock | A45F 5/00 224/257 |
| 5,791,076 | A * | 8/1998 | Gailliard | 40/1.5 |
| 2006/0070277 | A1* | 4/2006 | Bungerz | 40/544 |
| 2010/0050485 | A1* | 3/2010 | Forte et al. | 40/1.5 |
| 2010/0175286 | A1* | 7/2010 | Felix | 40/1.5 |

* cited by examiner

*Primary Examiner* — Joanne Silbermann
(74) *Attorney, Agent, or Firm* — Roman Aguilera, III

(57) ABSTRACT

Disclosed herein is a device and method directed to assisting individuals in identifying the wearer of the device. More specifically, the present invention generally relates to a device and method of use directed to assisting individuals in identifying the wearer of the device as a law enforcement officer (LEO) from various viewing angles of the wearer in lighted and unlighted environmental conditions. In one embodiment the device is comprised of identification elements, attachment elements, and quick disconnect elements. In another embodiment, the device is comprised of at least four identification elements, the attachment elements formed to hold two of the identification elements in the front and two in the back of the wearer of the device, and quick disconnect elements positioned along the attachment elements so that the wearer of the device can quickly interchange the identification elements and/or remove the device from the wearer.

1 Claim, 7 Drawing Sheets

LAW ENFORCEMENT OFFICER IDENTIFIER

CROSS-REFERENCE TO RELATED APPLICATIONS

This application claims the benefit under Title 35 United States Code §119(e) of U.S. Provisional Patent Application Ser. No. 61/896,257; Filed: Oct. 28, 2013, the full disclosure of which is incorporated herein by reference.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATING-BY-REFERENCE OF MATERIAL SUBMITTED ON A COMPACT DISC

Not applicable

SEQUENCE LISTING

Not applicable

FIELD OF THE INVENTION

The present invention generally relates to a device directed to assisting individuals in identifying the wearer of the device. More specifically, the present invention generally relates to a device directed to assisting individuals in identifying the wearer of the device as a law enforcement officer (LEO) from various viewing angles of the wearer in lighted and unlighted environmental conditions.

BACKGROUND OF THE INVENTION

Without limiting the scope of the disclosed device, the background is described in connection with a novel device and method of use to efficiently and effectively assist individuals in identifying the wearer of the device as a law enforcement officer from various viewing angles of the wearer in lighted and unlighted environmental conditions.

Law enforcement officers or LEOs are always expected to act in their capacities whether they are on or off duty. They may be responding to a robbery, burglary, domestic violence act, active shooter, etc. When they are off duty, most likely they are in plain clothes without their full gear and uniforms. Law enforcement officers are put in a situation where they are on an active scene with little or no visible identification as being a law enforcement officer. What others perceive is another possible suspect on the scene carrying a weapon. This situation also presents itself with undercover officers. Often times, when on duty law enforcement officers in uniform arrive on the scene, they mistakenly identify the off duty plain clothes law enforcement officer as a threat. Unfortunately, in many instances, the off duty plain-clothes officer is shot. These situations are also known as blue on blue.

To help alleviate this issue, several approaches in the prior art have been taken to assist in the identification of individuals as law enforcement officers or a friend or foe determination, as is often referred to. The following two examples are the most commonly used today.

As a first example, law enforcement officers will carry a belt badge or the assigned badge attached on a clip that attaches to the wearer's belt. These badges are usually placed next to their firearm, which is also attached to their belt. The idea is that individuals will locate a possible threat and identify the firearm along with the identification badge next to that firearm. While this approach is better than not having any identification at all, there are several issues with this. The biggest issue is that the location of the identification badge is at only one location on the law enforcement officer and the identification badge is not viewable on the plain clothes law enforcement officer from a majority of positions such as from their back. While they may have the identification, it is not easily seen. Research has also shown that the center of mass of an individual is the best placement for identification badges. Partly this is because law enforcement officers are trained to place shots through the suspect's center of mass as an aiming point and for effective shots. In addition, in various lighting conditions, these devices are not easily seen.

As a second example, law enforcement officers will carry a chain badge. That is, the badge is strung on a single loop neck chain so that the badge rests in the center of their chest. This approach also has several issues. The biggest issue is also that the location of the identification badge is at only one location on the law enforcement officer and it is not viewable on the plain-clothes law enforcement officer from a majority of positions. While this placement location is better than a belt badge, this badge device can easily flip to the back of the law enforcement officer or move around while running. In addition, in a physical confrontation, this badge device in the prior art may be used as a grabbing point to pull on the law enforcement officer. Lastly it is easily hidden if the law enforcement officer stands in the classic isosceles shooting stance. While worn correctly, the back of the plain-clothes law enforcement officer cannot be identified from the back. In addition, in various lighting conditions, these devices are not easily seen.

While all of the aforementioned devices may fulfill their unique purposes, none of them fulfill the need for a practical, effective, and efficient means for identifying law enforcement officers from various viewing angles in various environmental lighting conditions that is also easy to attach and detach.

Therefore, the present invention proposes a novel device and method of use to assist individuals in identifying the wearer of the device as a law enforcement officer from various viewing angles of the wearer in various environmental lighting conditions.

BRIEF SUMMARY OF THE INVENTION

The present invention, therefore, provides for a device directed to assisting individuals in identifying the wearer of the device.

In one embodiment the device is comprised of identification elements, attachment elements, and quick disconnect elements. In another embodiment, the device is comprised of at least four identification elements, the attachment elements formed to hold two of the identification elements in the front and two in the back of the wearer of the device, and quick disconnect elements positioned along the attachment elements so that the wearer of the device can quickly remove, add, and/or interchange the identification elements and/or remove the device from the wearer. In another embodiment, the device can quickly be attached to an individual by the individual placing the device over their head so that the device rests on their shoulder neck area placing two identification elements in the chest area and two identification elements in the back area of the individual. In yet another embodiment, the identification elements may contain illumination elements such as lights and/or reflectors, which may have various light settings such as off, fixed, and strobe.

In summary, the present invention discloses a device directed to assisting individuals in identifying the wearer of the device. More specifically, the present invention generally relates to a device directed to assisting individuals in identifying the wearer of the device as a law enforcement officer from various viewing angles of the wearer in lighted and unlighted environmental conditions.

BRIEF DESCRIPTION OF THE SEVERAL VIEWS OF THE DRAWINGS

For a more complete understanding of the features and advantages of the present invention, reference is now made to the detailed description of the invention along with the accompanying figures in which.

DETAILED DESCRIPTION OF THE INVENTION

Disclosed herein is an improved device and method of use directed to assisting individuals in identifying the wearer of the device as a law enforcement officer from various viewing angles of the wearer in lighted and unlighted environmental conditions. The numerous innovative teachings of the present invention will be described with particular reference to several embodiments (by way of example, and not of limitation).

Figure 1:
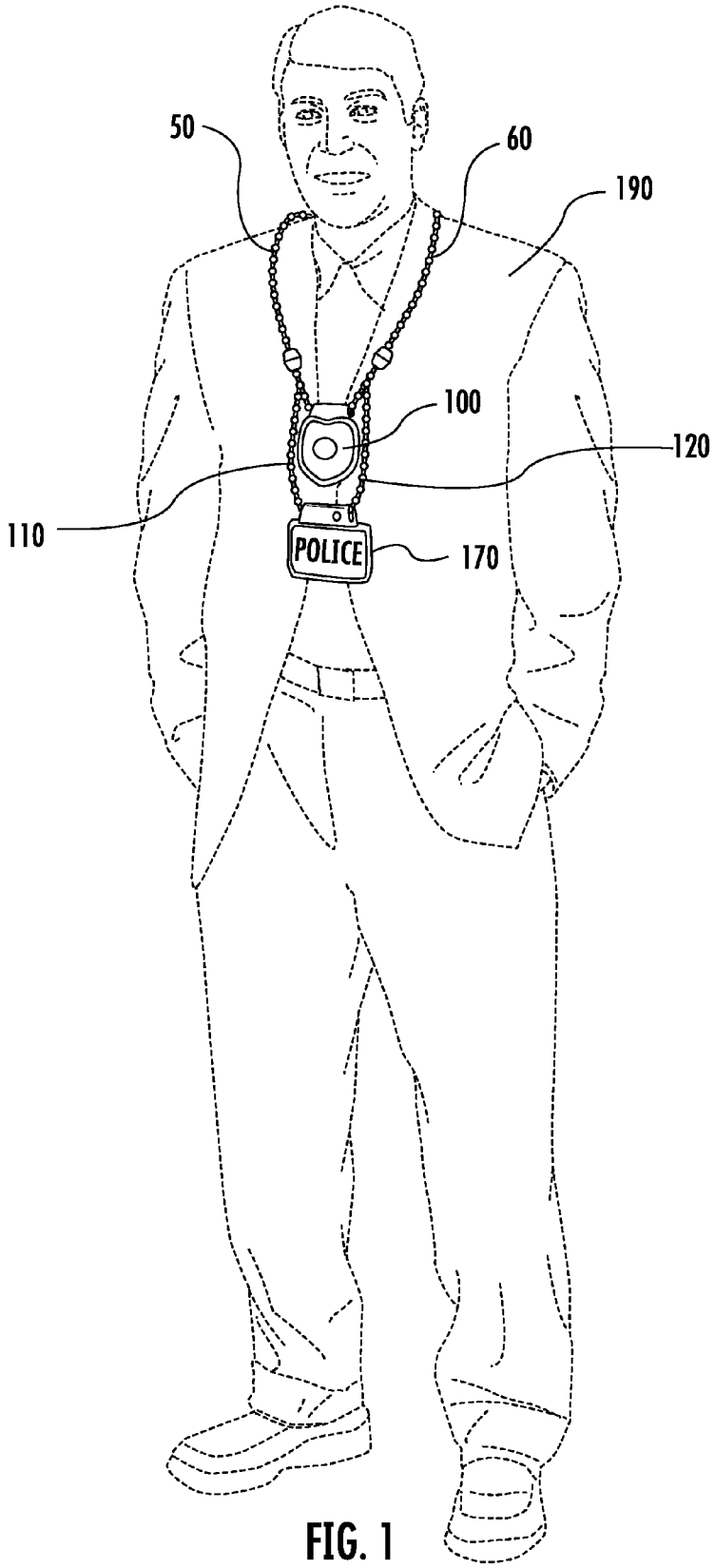
FIG. 1 is an environmental front side perspective view of the law enforcement officer identifier device in accordance with embodiments of the disclosure.

Reference is first made to FIG. 1, an environmental front side perspective view of the law enforcement officer identifier device in accordance with embodiments of the disclosure. In this illustration the law enforcement identifier is shown being worn by a plain-clothes law enforcement officer 190. The front half of the device is seen with the left side of the upper attachment element 50 and the right side of the upper attachment element 60 coming over his shoulders and placing the front side identification elements 100, 170 in the upper and mid chest areas. These front side identification elements 100, 170 may be but not limited to issued badges, non-issued badges, reflective badges, and other identifying material. Also seen in this illustration are the front left side of the lower attachment element 110 and the front right side of the lower attachment element 120. The law enforcement officer identifier device is easily stored by folding up the device and placing it in a pouch, which can be attached to a belt, or storing the device in one's pocket. The law enforcement officer 190 may also wear the device under his shirt and when needed to quickly deploy, can pull the device out of his shirt for quick identification by others.

Figure 2:
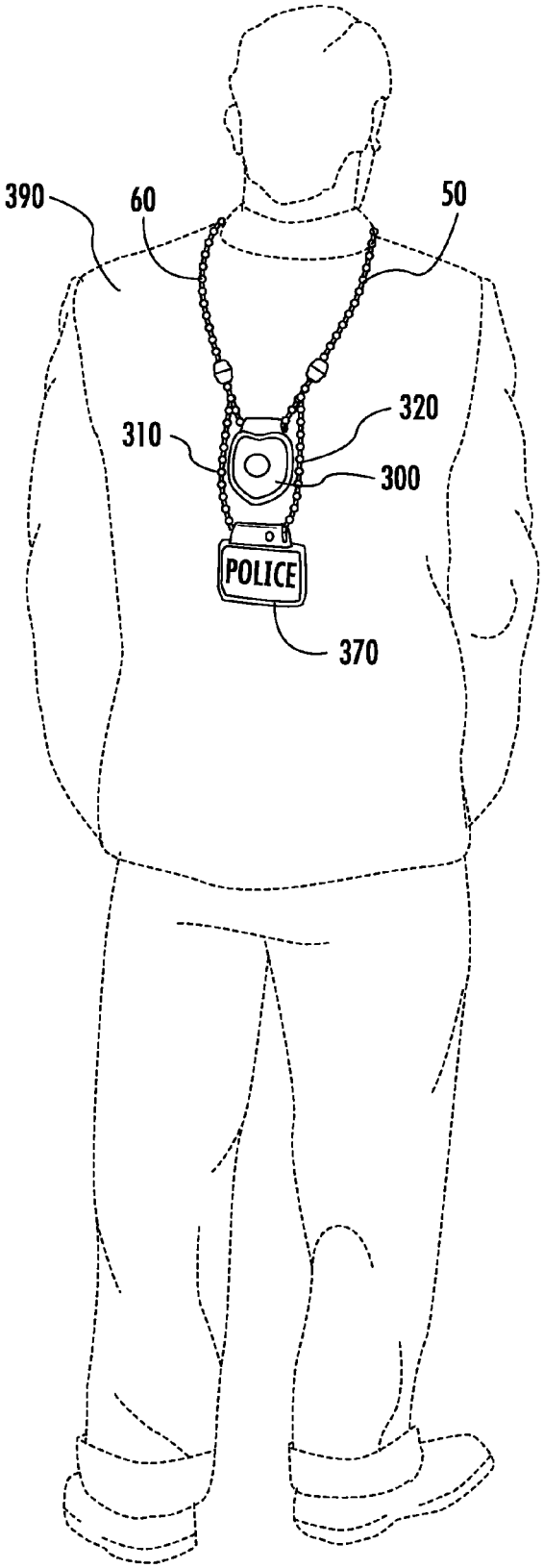
FIG. 2 is an environmental back side perspective view of the law enforcement officer identifier device in accordance with embodiments of the disclosure.

Reference is next made to FIG. 2, an environmental back side perspective view of the law enforcement officer identifier device in accordance with embodiments of the disclosure. In this illustration, shown is the back half of the device. From FIG. 1 the left side of the upper attachment element 50 and the right side of the upper attachment element 60 are seen continuing from the front side of the law enforcement officer 190 to the back side of the law enforcement officer 390 and placing the back side identification elements 300, 370 in the areas of the back of the individual. Like the front side identification elements 100, 170 the back side identification elements 300, 370 may be but limited to issued badges, non-issued badges, reflective badges, and other identifying material. Also seen in this illustration are the back left side of the lower attachment element 310 and the back right side of the lower attachment element 320.

Figure 3:
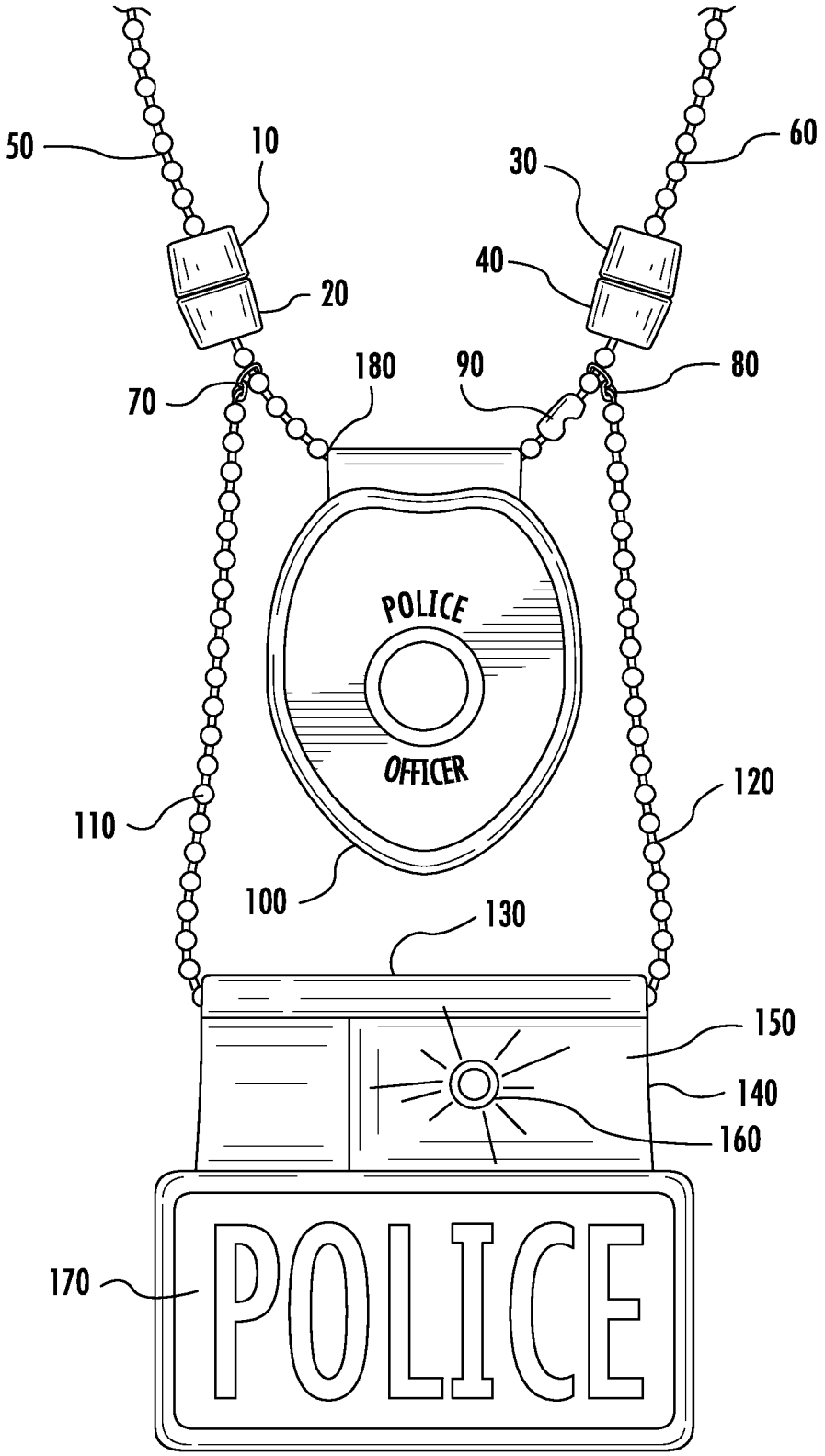
FIG. 3 is a front side view of the front half of the law enforcement officer identifier device in accordance with embodiments of the disclosure.

Reference is now made to FIG. 3, a front side view of the front half of the law enforcement officer identifier device in accordance with embodiments of the disclosure. In this illustration shown are the components that make up the front half of the law enforcement officer identifier. In an embodiment, the back half contains the same elements as the front half of the law enforcement identifier as can be seen in FIG. 2 and FIG. 3. That is, item 100 on the front corresponds to 300 on the back. Item 110 on the front corresponds to 310 on the back. 120 on the front corresponds to 320 on the back. Item 170 on the front corresponds to 370 on the back. Item 10 on the front corresponds to 210 on the back. Item 20 on the front corresponds to 220 on the back. Item 70 on the front corresponds to 270 on the back. Item 90 on the front corresponds to 290 on the back. Item 130 on the front corresponds to 330 on the back. Item 160 on the front corresponds to 360 on the back. Item 170 on the front corresponds to 370 on the back.

In one embodiment, the device is comprised of identification elements 100, 170, 300, 370, attachment elements 50, 60, 110, 120, 310, 320, and 14 quick disconnect elements 10, 20, 30, 40, 70, 80, 90, 210, 220, 270, 290. In another embodiment, the device is comprised of at least four identification elements 100, 170, 300, 370, the attachment elements 50, 60, 110, 120, 310, 320 formed to hold two of the identification elements 100, 170 in the front and two in the back 300, 370 of the wearer of the device, and quick disconnect elements 10, 20, 30, 40, 70, 80, 90, 210, 220, 270, 290 position along the attachment elements 50, 60, 110, 120, 310, 320 so that the wearer of the device can quickly interchange the identification elements 100, 170, 300, 370 and/or remove the device from the wearer.

In an embodiment, the attachment elements 50, 60, 110, 120, 310, 320 are stainless steel ball chains and/or black coated ball chains. In yet another embodiment the attachment element portions 50, 60 are stainless steel and the attachment elements 110, 120, 310, 320 are black coated such as with rubber or paint to aid the wearer of the device in quick deployment i.e. putting on of the device. When a law enforcement officer is placed in a situation where he has to react quickly, he has to be able to extract the device and get it on quickly. He does not have time to stare at the device and decide which side is which. The stainless steel attachment elements 50, 60 can quickly be identified and the user's head placed through the attachment elements 50, 60.

In another embodiment, the 8 quick disconnect elements 10, 20, 30, 40, 210, 220 are barrel breakaway safety buckles. These 8 barrel breakaway safety buckles 10, 20, 30, 40, 210, 220 allows the law enforcement device to be quickly removed and prevents others from grabbing the device to pull on the law enforcement officer or prevent others from attempting to choke the wearer with the device. In addition, the barrel safety buckles 10, 20, 30, 40, 210, 220 prevents the wearer from becoming caught on something such as a fence when wearing the law enforcement identifier device. If someone were to try to pull the law enforcement officer by the device, the barrel breakaway safety buckles 10, 20, 30, 40, 210, 220 would detach to prevent this action from occurring. In another embodiment, the 4 quick disconnect elements 70, 80, 270 are AD coupling with stainless steel hole diameters of 0.130 inches. These 4 AD coupling 70, 80, 270 allows the lower attachment elements 110, 120, 310, 320 to be disconnected so that the lower identification elements 170, 370 can be interchanged easily. In another embodiment, the quick disconnect elements 90, 290 are ball chain connectors. The ball chain connectors 90, 290 allows the left and right side upper attachment elements 50, 60 to be disconnected so that the upper identification elements 100, 300 can be interchanged easily. To help facilitate the 12 quick disconnect elements 10, 20, 30, 40, 70, 80, 210, 220 from changing positions on the attachment elements 50, 60, 110, 120, 310, 320 several fixation means may be employed such as but not limited to 3/16 of an inch nickel plated brass open balls can be positioned on the 12 attachment elements 10, 20, 30, 40, 70, 80, 210, 220 on the outside of each of the barrel breakaway safety buckles 10, 20, 30, 40 and the 4 AD couplings 70, 80, 270.

Figure 4:
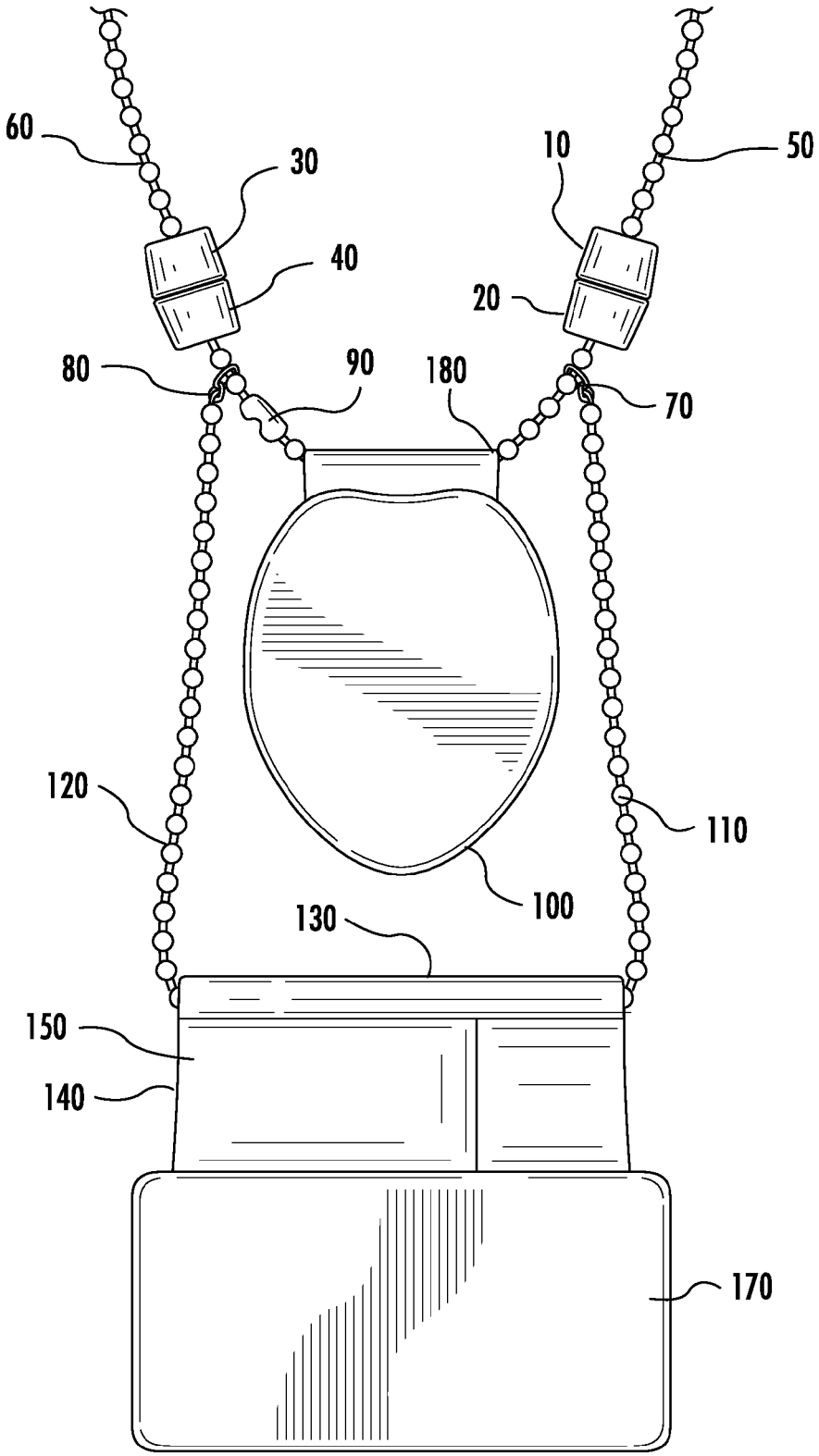
FIG. 4 is a back side view of the front half of the law enforcement officer identifier device in accordance with embodiments of the disclosure.

In yet another embodiment, the identification elements 100, 170, 300, 370 are two sided so that if they are flipped from physical movements or struggles of the law enforcement officer, the identification elements 100, 170, 300, 370 can be viewed from either side. In other embodiments, the identification elements 100, 170, 300, 370 contain reflective portions to aid in identification at night or low light conditions. In various other embodiments the identification elements 100, 170, 300, 370 contain a light-emitting source. In an embodiment, the light-emitting source is housed in a light-emitting source pocket 150 with a light-emitting source eyelet 160 to allow the light-emitting source to shine through. The light-emitting source pocket 150 also has a light-emitting source pocket opening 140 on the side that can be opened and closed through closure means such as Velcro. In another embodiment, the light-emitting source eyelet 160 is also on the back side of the light-emitting source pocket 150. The back side of the light emitting source pocket 150 is shown in FIG. 4. This allows the wearer the flexibility in being able to flip the direction or side that light emitting source shines through. The wearer can have one side selected or even two sides if desired. In one embodiment, the light-emitting source is an all purpose adhesive light strip (APALS). The all purpose adhesive light strip may have various light setting such as off, fixed, and strobe. This aids the law enforcement officer in being identified at night or low light environment settings.

Reference is next made to FIG. 4, a back side view of the front half of the law enforcement officer identifier device in accordance with embodiments of the disclosure. In this illustration, the back side of the identification elements 100, 170 can be seen. In an embodiment, the identification elements 100, 170, 300, 370 are two sided so that the back side of the identification elements 100, 170, 300, 370 are marked to identify the wearer of the law enforcement officer identifier. That is, if the law enforcement officer is engaged in physical activity or a struggle with another individual and the identification elements 100, 170, 300, 370 flip, the law enforcement officer can still be identified.

Figure 5:
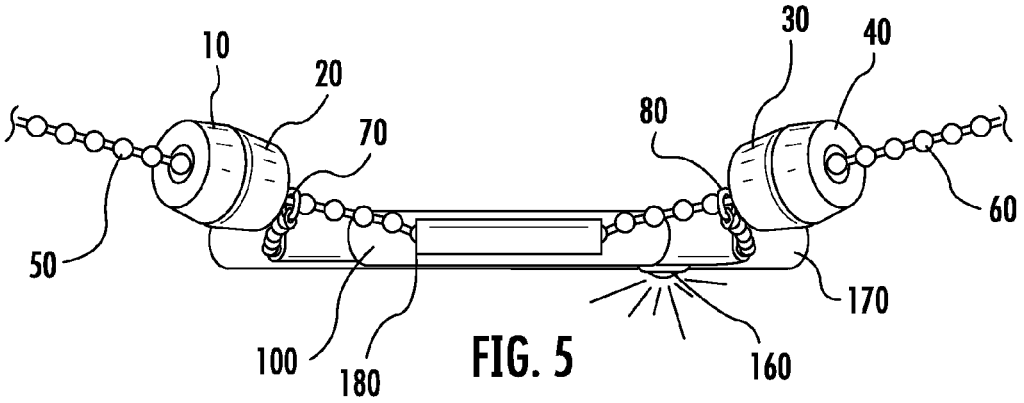
FIG. 5 is a top side view of the front half of the law enforcement officer identifier device in accordance with embodiments of the disclosure.

Reference is now made to FIG. 5, a top side view of the front half of the law enforcement officer identifier device in accordance with embodiments of the disclosure. In this illustration, the components of the top side of the front half of the law enforcement officer identifier can be readily seen. In an embodiment, the components are the same for back half of the law enforcement officer identifier.

Figure 6:
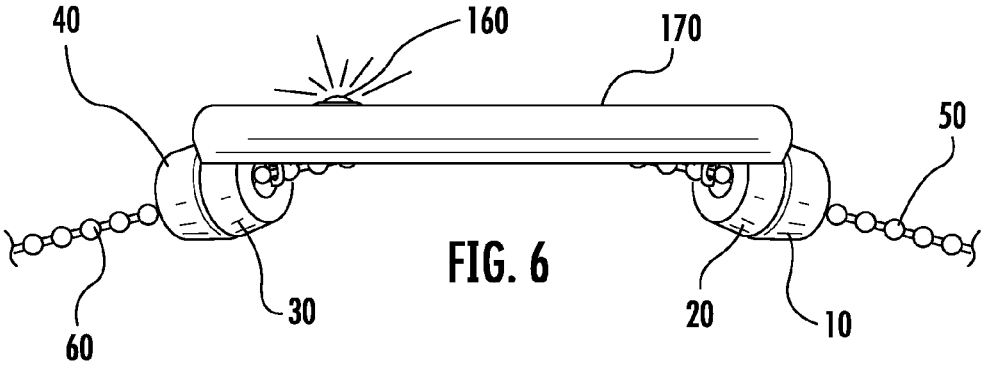
FIG. 6 is a bottom side view of the front half of the law enforcement officer identifier device in accordance with embodiments of the disclosure.

Reference is next made to FIG. 6, a bottom side view of the front half of the law enforcement officer identifier device in accordance with embodiments of the disclosure. In this illustration, the components of the bottom side of the front half of the law enforcement officer identifier can be readily seen. In an embodiment, the components are the same for back half of the law enforcement officer identifier.

Figure 7:
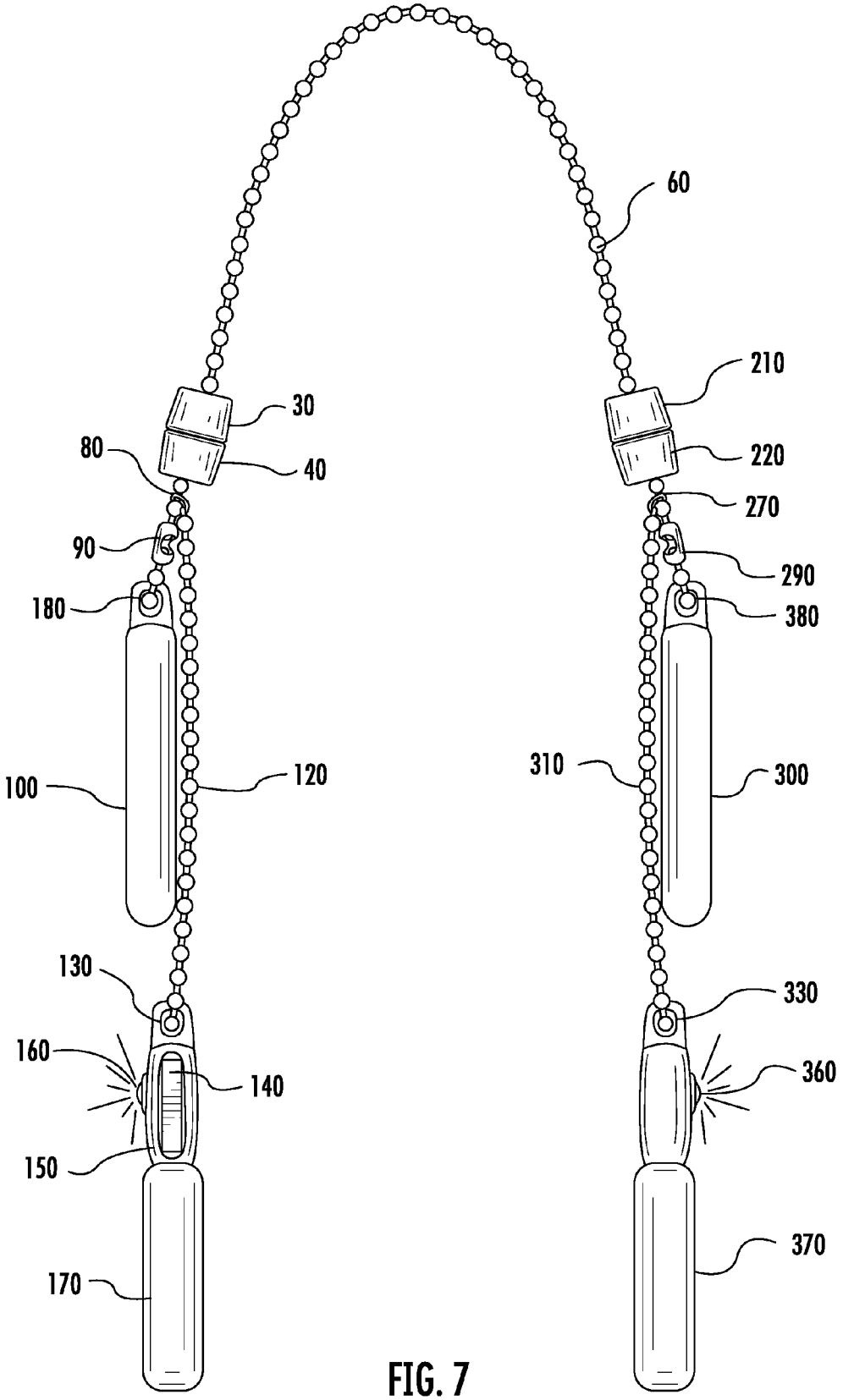
FIG. 7 is a right side view of the law enforcement officer identifier device in accordance with embodiments of the disclosure.

Reference is now made to FIG. 7, a right side view of the law enforcement officer identifier device in accordance with embodiments of the disclosure. Illustrated here and more readily seen is the front half and back half of the law enforcement officer identifier. Also more readily seen is the light-emitting source pocket 150, the light-emitting source pocket opening 140, and the light-emitting source eyelet 160, 360. In addition, seen here with better clarity are the identification element's loop fold feature 130, 180, 330, 380 which allows the attachment elements 50, 60, 110, 120, 310, 320 to be threaded through to hold the identification elements 100, 170, 300, 370. Having two identification elements 100, 170, 300, 370 on the front and back side of the law enforcement officer allows identification of the officer from many more angles.

Figure 8:
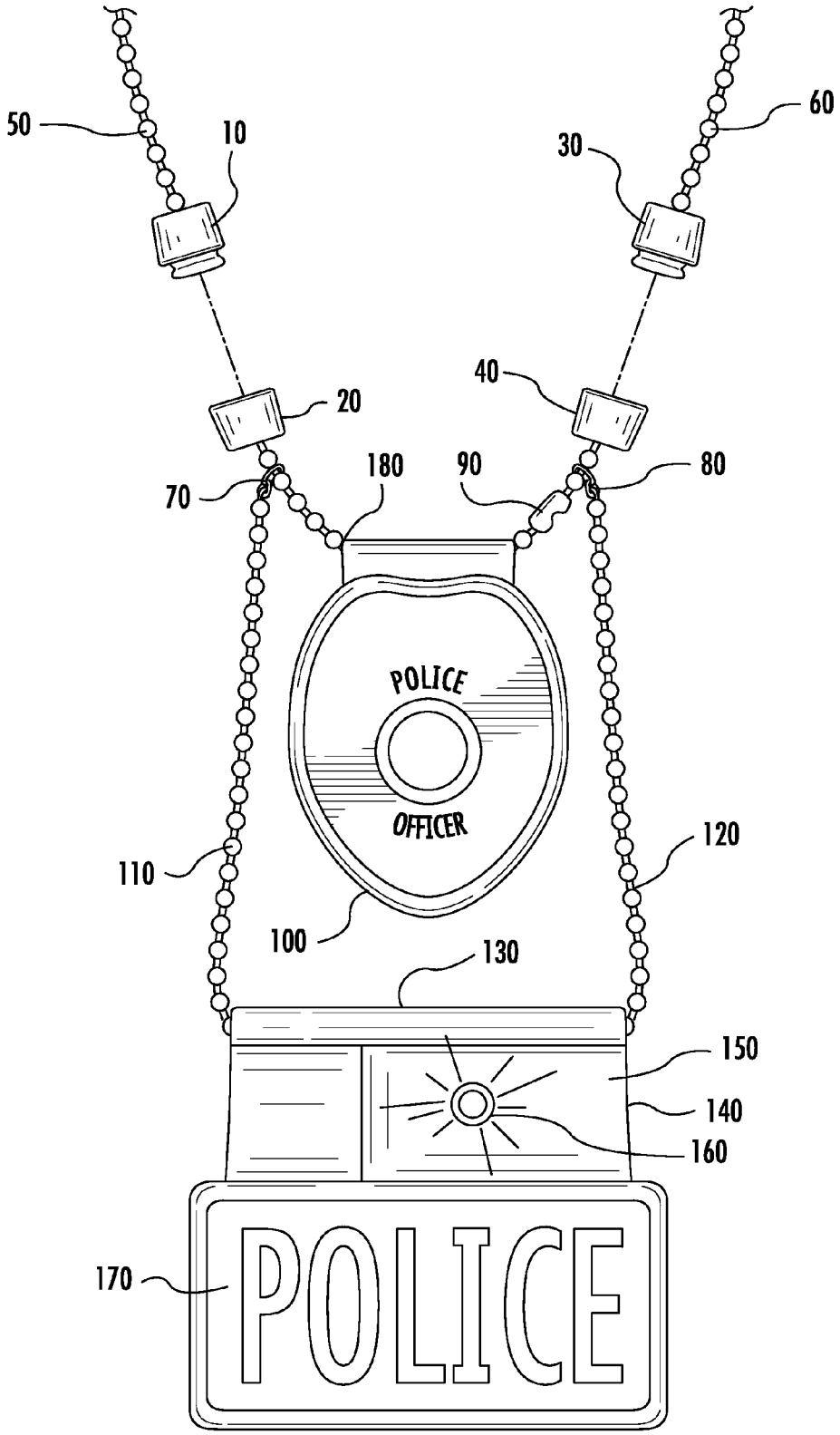
FIG. 8 is a front side view of the front half of the law enforcement officer identifier device illustrating the barrel breakaway release buckles being detached in accordance with embodiments of the disclosure.

Reference is lastly made to FIG. 8, a front side view of the front half of the law enforcement officer identifier device illustrating the barrel breakaway release buckles 10, 20, 30, 40 being detached in accordance with embodiments of the disclosure. Illustrated here is an embodiment with the 8 quick disconnect elements 10, 20, 30, 40, 210, 220 being barrel breakaway safety buckles in the detached position. This illustrates the quickness of which the law enforcement officer identifier can be removed from the law enforcement officer when needed as well as how quickly and efficiently the identification elements portion of the device can be switched out. Not much force is needed for the barrel breakaway safety buckles to become detached.

In brief, the device is directed to a device directed to assisting individuals in identifying the wearer of the device.

The disclosed device and method is generally described, with examples incorporated as particular embodiments of the invention and to demonstrate the practice and advantages thereof. It is understood that the examples are given by way of illustration and are not intended to limit the specification or the claims in any manner.

To facilitate the understanding of this invention, a number of terms may be defined below. Terms defined herein have meanings as commonly understood by a person of ordinary skill in the areas relevant to the present invention. Terms such as "a", "an", and "the" are not intended to refer to only a singular entity, but include the general class of which a specific example may be used for illustration. The terminology herein is used to describe specific embodiments of the invention, but their usage does not delimit the disclosed device or method, except as may be outlined in the claims.

Alternative applications for this invention include using this device for identifying personnel in various environments such as search and rescue, first responders, medical emergencies, military applications, and other environments where personnel need to be identified easily. Consequently, any embodiments comprising a one piece or multi piece device having the structures as herein disclosed with similar function shall fall into the coverage of claims of the present invention and shall lack the novelty and inventive step criteria.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific device and method of use described herein. Such equivalents are considered to be within the scope of this invention and are covered by the claims.

All publications and patent applications mentioned in the specification are indicative of the level of those skilled in the art to which this invention pertains. All publications and patent application are herein incorporated by reference to the same extent as if each individual publication or patent application was specifically and individually indicated to be incorporated by reference.

In the claims, all transitional phrases such as "comprising," "including," "carrying," "having," "containing," "involving," and the like are to be understood to be open-ended, i.e., to mean including but not limited to. Only the transitional phrases "consisting of" and "consisting essentially of," respectively, shall be closed or semi-closed transitional phrases.

The device and/or methods disclosed and claimed herein can be made and executed without undue experimentation in light of the present disclosure. While the device and methods of this invention have been described in terms of preferred embodiments, it will be apparent to those skilled in the art that variations may be applied to the device and/or methods and in the steps or in the sequence of steps of the method described herein without departing from the concept, spirit, and scope of the invention.

More specifically, it will be apparent that certain components, which are both shape and material related, may be substituted for the components described herein while the same or similar results would be achieved. All such similar substitutes and modifications apparent to those skilled in the art are deemed to be within the spirit, scope, and concept of the invention as defined by the appended claims.

What is claimed is:

1. An identifier device comprising:

an upper attachment element forming a loop;

a front lower attachment element;

a back lower attachment element;

an identification element attached to the front side of said upper attachment element;

an identification element attached to the back side of said upper attachment element;

a quick disconnect element on each side of said identification elements', on said upper attachment element;

a quick disconnect element between said front side upper attachment element identification element and a front side upper attachment element quick disconnect element;

a quick disconnect element between said back side upper attachment element identification element and a back side upper attachment element quick disconnect element;

said front lower attachment element having quick disconnect elements on each end and wherein one quick disconnect element attaches to said upper attachment element on the left side of said upper attachment element at the position between said upper attachment's left quick disconnect element and said front side upper attachment's identification element and wherein said other quick disconnect element attaches to said upper attachment element on the right side of said upper attachment element at the position between said upper attachment's right quick disconnect element and said front side upper attachment's identification element;

said back lower attachment element having quick disconnect elements on each end and wherein one quick disconnect element attaches to said upper attachment element on the left side of said upper attachment element at the position between said upper attachment's left quick disconnect element and said back side upper attachment's identification element and wherein said other quick disconnect element attaches to said upper attachment element on the right side of said upper attachment element at the position between said upper attachment's right quick disconnect element and said back side upper attachment's identification element;

an identification element attached to the front lower attachment element;

an identification element attached to the back lower attachment element.

* * * * *